US008491282B2

(12) United States Patent
Shaver et al.

(10) Patent No.: US 8,491,282 B2
(45) Date of Patent: Jul. 23, 2013

(54) PRESSURE MITIGATING DIELECTRIC DEBRIS SEAL FOR A POTHEAD INTERFACE

(75) Inventors: Clark D. Shaver, Inola, OK (US); Jeffrey G. Frey, Broken Arrow, OK (US); Terry L. Glascock, Vinita, OK (US)

(73) Assignee: Baker Hughes Incorporated, Houston, TX (US)

( * ) Notice: Subject to any disclaimer, the term of this patent is extended or adjusted under 35 U.S.C. 154(b) by 419 days.

(21) Appl. No.: 12/838,924

(22) Filed: Jul. 19, 2010

(65) Prior Publication Data

US 2012/0014822 A1 Jan. 19, 2012

(51) Int. Cl.
*F04B 17/00* (2006.01)

(52) U.S. Cl.
USPC ..... 417/423.3; 277/608; 277/626; 439/271; 439/191; 439/587

(58) Field of Classification Search
USPC ..... 417/423.3, 424.2; 439/271, 274, 439/275, 279, 587, 589, 191; 277/615, 608, 277/626, 644, 929; 166/66.4
See application file for complete search history.

(56) References Cited

U.S. PATENT DOCUMENTS

| | | | | |
|---|---|---|---|---|
| 4,193,657 | A * | 3/1980 | Slone | 439/598 |
| 4,486,002 | A * | 12/1984 | Riess et al. | 251/214 |
| 4,560,083 | A * | 12/1985 | Danico | 220/786 |
| 4,927,386 | A * | 5/1990 | Neuroth | 439/589 |
| 5,113,101 | A | 5/1992 | Liu | |
| 5,180,008 | A * | 1/1993 | Aldridge et al. | 277/322 |
| 5,567,170 | A * | 10/1996 | Kroeber | 439/186 |
| 6,361,342 | B1 | 3/2002 | Cox | |
| 6,409,485 | B1 | 6/2002 | Ebner | |
| 6,443,780 | B2 * | 9/2002 | Wilbourn et al. | 439/738 |
| 6,676,447 | B1 * | 1/2004 | Knox | 439/587 |
| 6,780,037 | B1 | 8/2004 | Parmeter | |
| 7,575,458 | B2 | 8/2009 | Parmeter | |
| 7,611,339 | B2 | 11/2009 | Tetzlaff | |
| 2006/0148304 | A1 | 7/2006 | Kennedy et al. | |
| 2008/0064269 | A1 | 3/2008 | Parmeter et al. | |
| 2009/0068037 | A1 | 3/2009 | Shaw | |
| 2009/0269956 | A1 | 10/2009 | Frey et al. | |
| 2009/0288818 | A1 | 11/2009 | Brown | |

FOREIGN PATENT DOCUMENTS

JP 01-243861 A 9/1989

OTHER PUBLICATIONS

International Search Report and Written Opinion (PCT/US2011/038726), dated Feb. 9, 2012.

* cited by examiner

*Primary Examiner* — Devon Kramer
*Assistant Examiner* — Joseph Herrmann
(74) *Attorney, Agent, or Firm* — Bracewell & Giuliani LLP

(57) ABSTRACT

A connector for connecting electrical power to a well pump motor has cable and motor connector portions that mate with each other in a connected position. The connector portions have insulating members, each of which has a number of passages and an end face. Electrical contact members are mounted in each of the passages. Contact members in the cable connector portion protrude past the end face of the insulating member. A debris seal insulates the electrical contact members in the cable connector and includes expansion slots so that when the material of the debris seal thermally expands, the expansion slots contract in response to the expansion without the debris seal impinging against either connector.

17 Claims, 4 Drawing Sheets

PRESSURE MITIGATING DIELECTRIC DEBRIS SEAL FOR A POTHEAD INTERFACE

1. FIELD OF THE INVENTION

This invention relates in general to downhole electrical connectors for use in electrical submersible pump applications, and in particular to a downhole pothead connector for use in oil wells.

2. BACKGROUND OF THE INVENTION

Electrical submersible pumps have been used in oil wells to pump well fluids for many years. These pumps are part of an assembly that includes a submersible motor. The pump assembly is typically suspended on tubing, and a power cable from the surface is strapped alongside the tubing. A motor lead is secured to the lower end of the power cable, the motor lead terminating in a connector that plugs into a receptacle of the motor. This connector is typically known as a pothead connector.

The motor is filled with a dielectric lubricant that is sealed from the exterior at the receptacle. The connector has seals that seal the electrical conductors from well fluid. A variety of connectors are known. In one type, the cable portion of the connector has a housing that contains two rigid insulating members separated by a deformable insulating member. Passages extend through the members for sealingly receiving the insulated electrical conductors. Electrical contact members or pins connect to the conductors and protrude past the forward insulating member. The remaining portion of the housing is filled with an epoxy.

The receptacle portion of the connector has a rigid insulating member with passages for receiving insulated conductors from the motor. Electrical contact members, typically sleeves, are located in the passages in the insulating member. When the cable portion of the connector is connected to the receptacle, the electrical contact pins slide into the electrical contact sleeves. If the motor lubricant becomes contaminated, debris from the oil can encroach into the connector and come into contact with the electrical contact members. The debris can cause electrical arcing in this region. A debris seal is generally included for isolating the sleeves (or pin connections) from debris and to provide dielectric strength between the pins and each pin and ground. Temperature increases in the wellbore may thermally expand the debris seal, that in turn can press outward against the connector assembly and increase internal pressure of the assembly.

SUMMARY

Disclosed herein is a submersible well pump assembly, in an example embodiment the submersible well pump assembly includes a submersible electrical motor that has an electrical motor lead so it can be connected to a power cable. The motor lead has male and female connector portions, one of which is connected to the motor lead and the other to the motor. When the motor lead is in a connected position the connector portions are mated to one another. The male and female connector portions each have a plurality of passages and an end face; each male connector has a plurality of male electrical contact members mounted therein that protrude past the end face of the male connector and into each of the passages. The female connector has within each of its passages a plurality of female electrical contact members mounted and recessed therein. Further included is an elastomeric debris seal on the end face of the male connector portion; the debris seal has an insulating barrier with a plurality of bores circumscribing one of the male electrical contact members. The debris seal also includes at least one thermal expansion slot in the barrier that is spaced from each of the bores. Alternatively, the expansion slot extends from an outer periphery of the debris seal towards a center of the debris seal. In an example embodiment, the expansion slot is between a center of the debris seal and an outer periphery of the debris seal and spaced from the outer periphery of the debris seal. The debris seal can expand in response to an increase in temperature and into the expansion slot so that a contact force between the debris seal and the faces is substantially constant during the increase in temperature. In optional embodiments, the expansion slot has a curved outer periphery, can be generally elongate, or can be a plurality of expansion slots formed through the debris seal. Yet further optionally, the debris seal can be set at angular positions with respect to a center of the debris seal and each other, and are offset from angular positions of the bores. In this option, the expansion slots can be equidistant apart and located on the debris seal at angular positions with respect to a center of the debris seal or can be located on the debris seal at angular positions with respect to a center of the debris seal that are aligned with angular positions of the bores.

Disclosed herein is an example embodiment of a submersible well pump assembly that is made up of a submersible electrical motor having an electrical motor lead that enables connection to a power cable. The assembly of this embodiment also includes a cable end housing to facilitate connection to the motor lead. In the housing is a cable insulating member made of an insulating material, a plurality of passages is formed through the insulating member. In the passages are a plurality of electrical conducting cable contact members that are joined to the motor lead. Each cable contact member protrudes past an end face of the cable insulating member. A motor insulating member of insulating material is included that mounts in a receptacle of the electrical motor. The motor insulating member has an end face and passages extending through the motor insulating member. A plurality of electrical conducting motor contact members are provided in each one of the passages of the motor insulating member, the contact members are engaged by the cable contact member when the cable end housing and the receptacle are in a connected position. Further included is a debris seal on the end face of the cable insulating member, in an example embodiment the debris seal is an elastomeric insulating disc having a plurality of bores each circumscribing one of the cable contact members, and a plurality of thermal expansion slots in the barrier that are spaced from each of the bores. Expansion slots may be located on the debris seal at angular positions with respect to a center of the debris seal that are offset from angular positions of the bores. The debris seal can expand in response to an increase in temperature and wherein substantially all of the expansion is directed into the expansion slot so that a contact force between the debris seal and the faces is substantially constant during the increase in temperature. Each expansion slot can have a curved outer periphery or be generally elongate. The debris seal can be a generally planar member set generally perpendicular to the cable contact members. In an example embodiment, the expansion slot is between a center of the debris seal and an outer periphery of the debris seal and spaced from the outer periphery of the debris seal.

Also disclosed herein is a submersible well pump assembly; in an example embodiment the submersible well pump assembly has a submersible electrical motor connectable to a power cable by an electrical motor lead. A cable end housing is on the power cable for connection to the motor lead, in the housing is a cable insulating member of insulating material with passages formed therethrough. Cable contact members are mounted in each passage of the cable insulating member and joined to the motor lead. Each cable contact member protrudes past an end face of the cable insulating member. Also included in a receptacle of the electrical motor is a motor insulating member of insulating material an end face and a plurality of passages therethrough. Each passage of the motor insulating member has a motor contact member that is engaged by the cable contact member when the cable end housing and the receptacle are in a connected position. A generally planar debris seal is provided on the end face of the cable insulating member. In an example embodiment, the debris seal is made of an elastomeric insulating disc having a plurality of bores each circumscribing one of the cable contact members and that expands in response to an increase in temperature and wherein substantially all of the expansion is directed into the expansion slot so that a contact force between the debris seal and the faces is substantially constant during the increase in temperature. The debris seal of this embodiment has thermal expansion slots in the barrier, each expansion slot spaced from each of the bores located on the debris seal at angular positions with respect to a center of the debris seal that are offset from angular positions of the bores. Optional embodiments include each expansion slot extending from an outer periphery of the debris seal towards a center of the debris seal or between a center of the debris seal and an outer periphery of the debris seal.

DETAILED DESCRIPTION OF THE INVENTION

Figure 1:
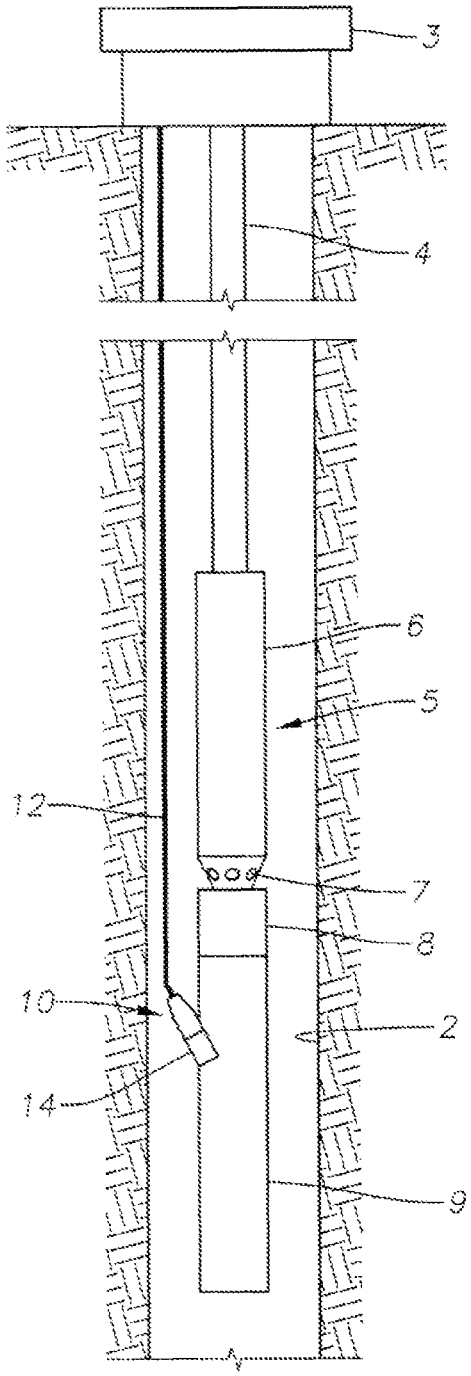
FIG. 1 is a side view of an example of an electrical submersible pumping system (ESP) in a borehole in accordance with the present disclosure.

Shown in a side partial sectional view in FIG. 1 is a wellbore 2 capped with a wellhead 3 and production tubing 4 depending from the wellhead 3 into the wellbore 2. An electrical submersible pumping system (ESP) 5 is shown attached on a lower end of the production tubing 4. In the example embodiment of FIG. 1, the ESP 5 includes a pump section 6 for pumping fluids from the wellbore 2 into the production tubing 4 and to the wellhead 3. Fluid (not shown) in the wellbore 2 flows into the pump section 6 through an inlet 7 shown formed on an outer surface of the pump section 6. On a lower end of the pump section 6 is a seal section 8 for equalizing pressure within the ESP 5 to ambient conditions. A motor section 9 is shown on a lower end of the seal section 8 that includes a motor (not shown) for driving impellers (not shown) in the pump section 6.

Figure 2:
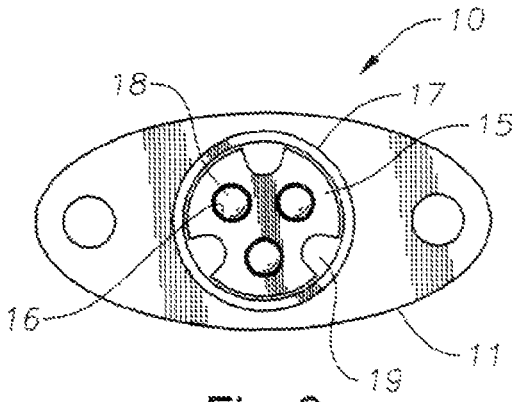
FIG. 2 is a side view of an example of a pothead connector in accordance with the present disclosure.

An elevational view of an embodiment of the pothead connector 10 of FIG. 1 is provided in FIG. 2. The pothead connector 10 includes connectors 18 that project outward from within an annular base 17 shown set on a connector flange 11. A circular debris seal 15 is shown set within the base 17 and disposed in a plane substantially perpendicular to the connectors 18. Bores 16 are provided in the debris seal 15 for insertion of each connector 18 that closely encircle each connector 18. The debris seal 15 insulates the connectors 18 from one another and from ground. The seal 15 should be able to maintain an, insulating function while experiencing operating temperatures that can sometimes exceed 350° F. The debris seal 15 can be manufactured from a polymeric material, such as for example a synthetic rubber or an ethylene propylene diene monomer. Expansion slots 19 are shown provided in the debris seal 15 at strategic locations; so that when the debris seal 15 temperature increases, the debris seal 15 material expands into the slots 19 instead of impinging upon the connector 10. The presence of the expansion slots 19 provides a space in which the material of the seal 15 can expand instead of up against the connector 10. The slots 19 of FIG. 2 are symmetrically disposed around the circumference of the debris seal 15 and project inward towards the center of the debris seal 15 from its outer edge and have a curvilinear periphery resembling an end portion of an ellipse. In an example embodiment, the expansion slots 19 are at angular positions of the debris seal 15 equidistant between adjacent pins 18. Optionally, the expansion slots 19 can be asymmetrically set around the periphery of the debris seal 15. While three expansion slots 19 are illustrated in the example embodiment of FIG. 2, alternate embodiments of the debris seal 15 exist having one, two, or more than three slots 19. In another alternative embodiment, expansion slots 19 may be set at generally the same angular position as the pins 18. In an example embodiment, a series of expansion slots 19 may be formed along the entire periphery of the debris seal 15.

Figure 3A:
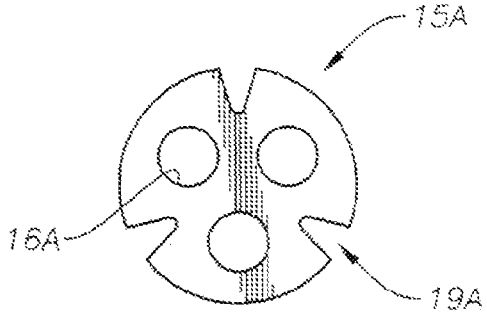
FIGS. 3A and 3B are alternate embodiments of a debris seal for use with the pothead connector of FIG. 2.
Figure 3B:
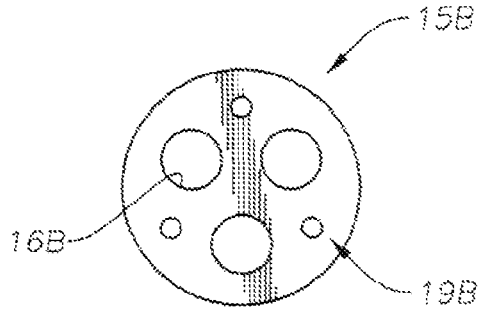

Shown in FIGS. 3A and 3B are alternate example embodiments of the debris seal 15 of FIG. 2. The expansion slots 19A of the debris seal 15A illustrated in FIG. 3A are elongate, where the elongate side projects into the debris seal 15A from its edge. Referring to the example embodiment of FIG. 3B, generally circular expansion slots 19B are provided in the debris seal 15B and set inward from its outer edge. The expansion slots 19A, 19B of FIGS. 3A and 3B are illustrated symmetrically positioned between bores 16A, 16B provided in the debris seals 15A, 15B. Bores 16A, 16B are similar to bores 16 and allow the pins 18 to pass therethrough. Alternative embodiments may asymmetrically position the expansion slots 19A, 19B within the debris seals 15A, 15B.

Figure 4:
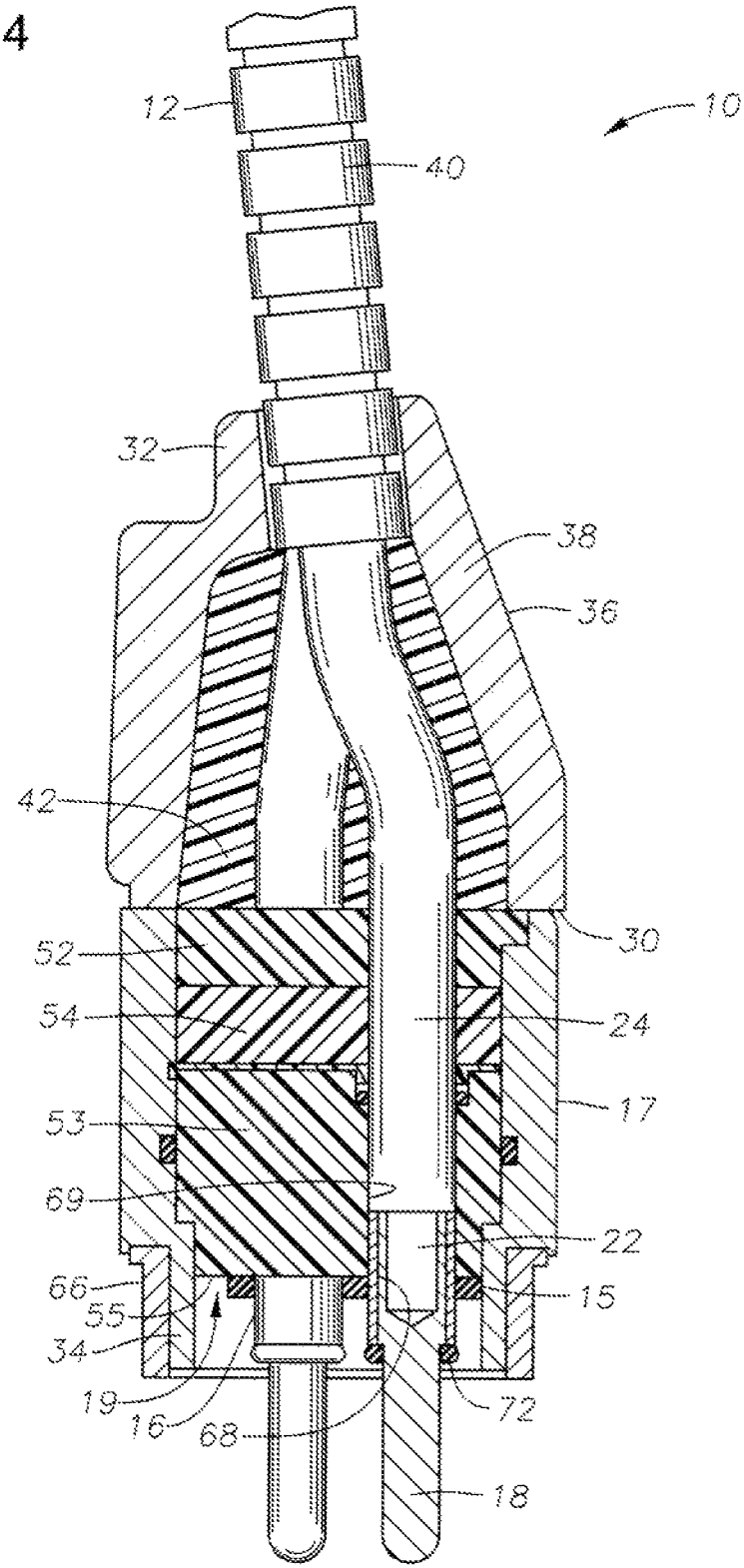
FIG. 4 is a longitudinal sectional view and depicts the interior of the pothead connector of FIG. 2 shown mounted to the terminal end of the flat downhole electric cable.

FIG. 4 is a longitudinal section view and depicts the interior of the pothead connector 10 made according to an embodiment of the present invention, mounted to the terminal end of a motor lead 12. The upper or rearward end of motor lead 12 is joined to an electrical cable extending to the surface of the well. Pothead connector 10 may have a wide variety of components. However, in this example, pothead connector 10 has a tubular housing 30 with a rearward end 32 through which cable 12 passes and a forward end 34 through which electrical conductor pins 18 extend. Pins 18 electrically connect to a female receptacle 14 of a down hole electrical submersible motor 9 (FIG. 2). Tubular housing 30 preferably comprises two opposite end pieces, base 17 and cap 36. Base 17 provides forward end 34, and cap 36 provides rearward end 32.

Still referring to FIG. 4, cap 36 of tubular housing 30 has a tapered tubular end 38 which extends around the exterior of armor 40 of motor lead 12. The interior of cap 36 is filled with epoxy 42, which acts as a retaining means to secure conductor pins 18 within cap 36 in alignment for extending into base 17. Epoxy 42 is a type of epoxy that is rated for high temperature service. The interior surface of the tapered tubular end 38 has a conical profile, with the rearward end periphery being smaller than the forward end periphery. After cap 36 is fastened to base 17 and epoxy 42 is cured, epoxy 42 will provide a conically shaped layer that is aligned within the conical profile of tapered tubular end 38 and prevents movement of cap 36 and base 17 inward over armor 40 of motor lead 12.

As shown in FIG. 4, armor 40 has been stripped back from the terminal end of electrical power cable 12, so that armor 40 has a terminal end of an electrical conductor 22 enclosed within the tapered tubular end 38 of cap 36. Preferably, each bare electrical conductor 22 is surrounded by one or more layers of conductor insulation 24 to protect and insulate the conductors from one another. Insulation layers 24 will preferably extend within epoxy layer 42 so that the epoxy of layer 42 will bond directly to insulation layers 24. The insulation layer 24 of each conductor 22 extends sealingly through a rearward rigid insulator member 52, as shown in FIG. 4, and through a deformable elastomeric seal member 54. In this example, seal member 54 is deformed between rearward insulation member 52 and a rigid forward insulation member 53. Insulation layer 24 of each conductor 22 extends into forward insulation member 53 but not all the way through forward insulation member 53.

At the outer end of base 17, bare electrical connectors 22 provide a terminal end of power cable 12. Conductor pins 18 have bores which are separately mounted and then soldered over the terminal ends of bare electrical connectors 22. Conductor pins 18 are provided for mating with electrical connectors in receptacle 14 (FIG. 1) of the submersible pump motor 9 (FIG. 1). Insulation layer 24 of each conductor 22 extends up to and may abut conductor pin 18, but does not extend over conductor pin 18.

Still referring to FIG. 4, electrical insulator members or blocks 52,53 may be formed of a hard engineering grade plastic, such as polyetheretherketone (PEEK), and mounted at the forward or lower end of base 17. Insulator blocks 52,53 are fixed within base 17 to prevent axial movement within the housing 30. Insulator blocks 52,53 and seal member 54 are provided with bores 69 therethrough for electrical conductors 22 and for aligning them with the conductor pins 18. In an example embodiment, forward insulator block 53 has a flat forward end 55 or face that is in a plane substantially perpendicular to conductor pins 18. An elastomeric sealing boot 66 may extend around a forward lip of base 17 and provide a seal between tubular housing 30 and electrical submersible motor 9. Boot 66 is shown in FIG. 4 but not in the other figures.

Shown set on the forward end 55 of insulator 53 is an example embodiment of the debris seal 15. In this embodiment the pins 18 are equipped with an optional outer annular sleeve 68 that fit closely around each of conductor pins 18 and protrude a short distance below forward face 55 of insulation block 53. Sleeve 68, if used, may be constructed to be part of conductor pins 18 and is formed of an electrically conductive metal. The sleeves 68 are shown inserted though the bores 16 of the debris seal 15. The inner diameter of each bore 16 is substantially the same as the outer diameter of sleeve 68 for each conductor pin 18. The expansion slot 19 is shown angularly offset from one of the conductor pins 18 and along a portion of the forward face 55.

In addition, an optional O-ring sleeve seal 72 may fit around each conductor pin 18 at the end or rim of each sleeve 68 to seal against any leakage between sleeve 68 and conductor pin 18. The sealing engagement is formed by the inner diameter and the rearward portion of sleeve seal 72 contacting a shoulder on conductor pin 18 and contacting the rim of sleeve 68. The outer diameter of sleeve seal 72 does not form a seal and is shown as being only slightly greater in diameter than sleeve 68.

Figure 5:
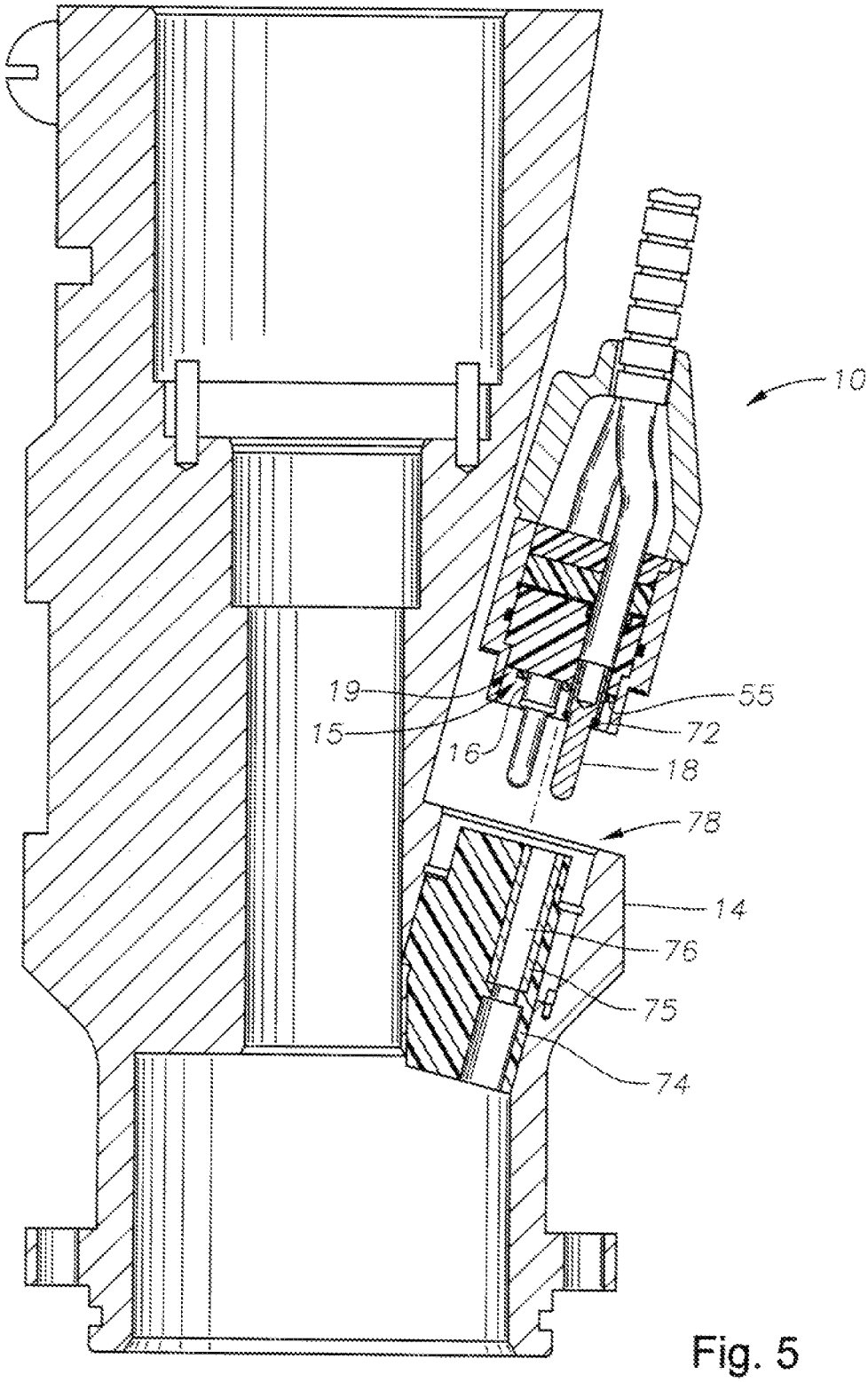
FIG. 5 is a side view of the pothead connector of FIG. 2 connecting to a female assembly.

Referring to FIG. 5 illustrates in a side sectional view example embodiments of the pothead connector 15 being electrically coupled with the female receptacle 14. In this example the pothead connector 15 is being positioned for insertion into the receptacle 14. The receptacle 14 of FIG. 5 includes a receptacle block 74 of a rigid insulation material and having a plurality of holes 76 (one shown), one for each conductor pin 18. A mating electrical conductor sleeve 75 (shown only in FIG. 5) is located within each hole 76 in receptacle block 74 to accept one of the conductor pins 18 as pothead 10 is connected to female receptacle 14. Each conductor sleeve 75 is connected to one of the wires within motor 9. Receptacle block 74 has a cylindrical portion with a diameter slightly smaller than the inner diameter of base 17 at its forward end for sliding into lip 17. Receptacle insulating member 74 has an end face 78 that is flat and parallel with end face 55 of insulating member 53.

Figure 6:
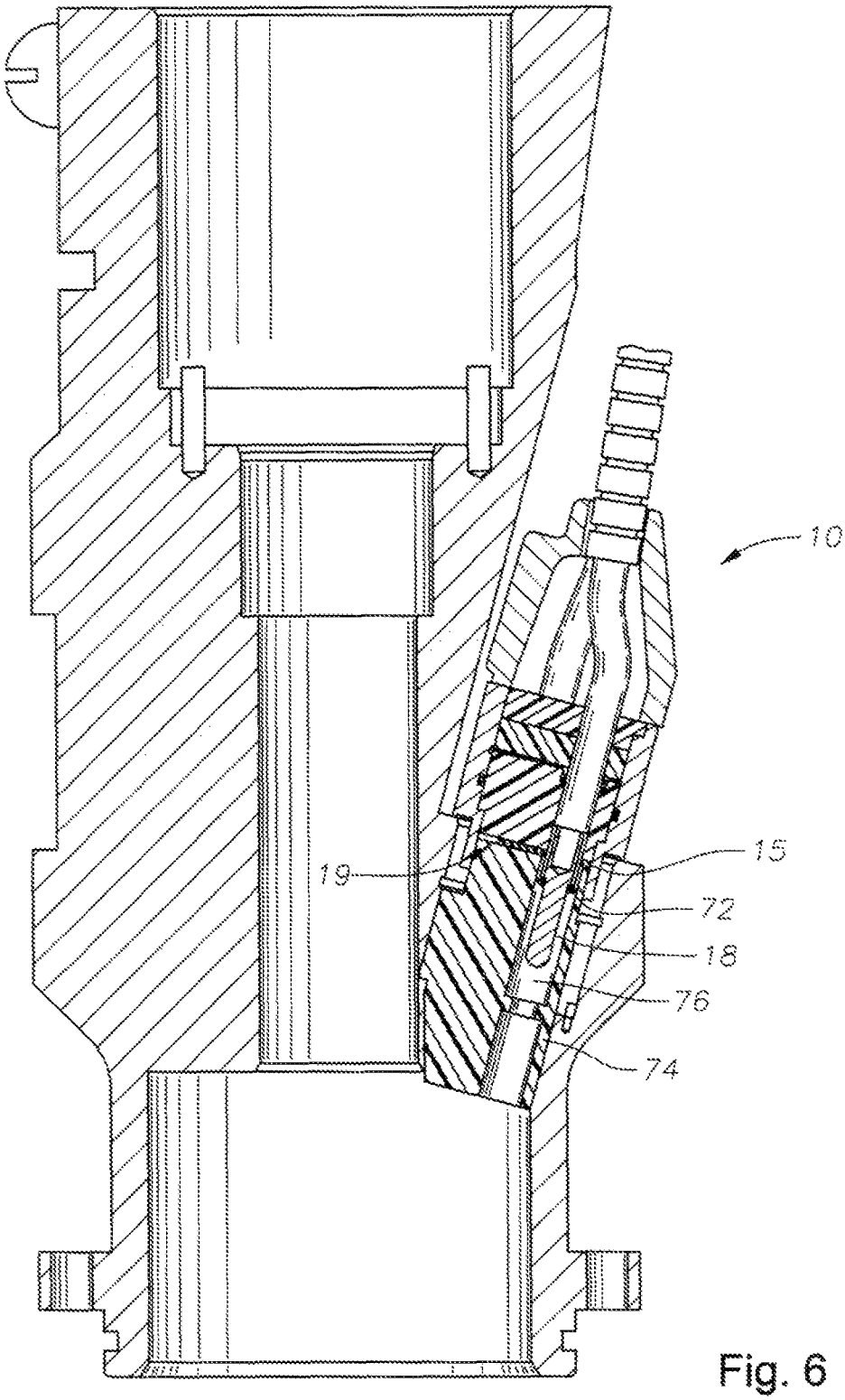
FIG. 6 is a side sectional view showing the pothead connector and female assembly of FIG. 5 connected to one another.

FIG. 6 illustrates an example embodiment of the pothead connector 10 electrically coupled to the receptacle 14. In the example of FIG. 6, the debris seal 15, which is between face 55 of insulation member 53 and face 78 of receptacle member 74, contacts faces 55, 78, thereby creating an effective barrier that prevents debris from getting into the area between conductor pin 18 and pothead 10. Although the expansion slot 19, in certain embodiments, allows gaps between the opposing faces 55, 78, the debris seal 15 provides a barrier that fully circumscribes and insulates each pin 18. As noted above, when thermally expanded, the debris seal 15 will expand into the gaps instead of pushing against the faces 55, 78 or base 17.

When connected, the optional sleeve seal 72 enters receptacle 76 but is not deformed by receptacle 76 because its outer diameter is smaller than the inner diameter of receptacle 76. If electrical contact sleeve 75 is sized appropriately, sleeve seal 72 may make contact with the end of electrical contact sleeve 75 to deform sleeve seal 72 against the rim of sleeve 68. The inner diameter of seal 72 forms a seal around conductor pin 18 and the rim of sleeve 68 to reduce entry of material between sleeve 68 and conductor pin 18.

The invention has significant advantages. The end face seals provide an additional barrier to the entry of contaminated material into the area of the electrical contacts. The sleeve seals, if employed, provide still another barrier. It is to be understood that the invention is not limited to the exact details of the construction, operation, exact materials or embodiment shown and described, as obvious modifications and equivalents will be apparent to one skilled in the art. For example, the pins could be located in the receptacle and the conductor sleeves could be located in the cable end housing.

We claim:

1. A submersible well pump assembly comprising:

a submersible electrical motor;

an electrical motor lead for connection to a power cable;

a male connector portion mates with a female connector portion in a connected position, one of the connector portions connected to the motor lead and the other connector portion is connected to the motor;

the male and female connector portions, each having a plurality of passages and an end face;

a plurality of male electrical contact members mounted in each of the passages of and protruding past the end face of the male connector portion;

a plurality of female electrical contact members mounted and recessed within each of the passages of the female connector portion;

an elastomeric debris seal on the end face of the male connector portion comprising an insulating barrier having a plurality of bores circumscribing one of the male electrical contact members; and a plurality of thermal expansion slots in the insulating barrier that are formed through the debris seal at angular positions with respect to a center of the debris seal and each other, and the expansion slots are offset from angular positions of the bores, and define a space, so that when a temperature of the insulating barrier increases and the insulating barrier expands, material of the insulating barrier is urged into the space.

2. The assembly of claim 1, wherein the plurality of thermal expansion slots extends from an outer periphery of the debris seal towards the center of the debris seal.

3. The assembly of claim 1, wherein the plurality of thermal expansion slots are spaced radially inward from an outer periphery of the debris seal.

4. The assembly of claim 1, wherein the debris seal expands in response to an increase in temperature and wherein substantially all of the expansion is directed into the plurality of thermal expansion slots so that a contact force between the debris seal and the end faces are substantially constant during the increase in temperature.

5. The assembly of claim 1, wherein the plurality of thermal expansion slots have a curved outer periphery.

6. The assembly of claim 1, wherein the thermal expansion slots are generally elongate.

7. The assembly of claim 1, wherein the plurality of thermal expansion slots are equidistant apart and located on the debris seal at angular positions with respect to the center of the debris seal.

8. The assembly of claim 1, wherein the plurality of thermal expansion slots are located on the debris seal at angular positions with respect to the center of the debris seal that are aligned with the angular positions of the bores.

9. A submersible well pump assembly comprising:

a submersible electrical motor;

an electrical motor lead for connection to a power cable;

a cable end housing for connection to the motor lead;

a cable insulating member of insulating material disposed within the housing and having a plurality of passages therethrough;

a plurality of electrical conducting cable contact members mounted in the passage of the cable insulating member and joined to the motor lead, each of the cable contact members protruding past an end face of the cable insulating member;

a motor insulating member of insulating material mounted in a receptacle of the electrical motor and having a plurality of passages therethrough, the motor insulating member having an end face;

a plurality of electrical conducting motor contact members in each one of the passages of the motor insulating member that is engaged by the cable contact member when the cable end housing and the receptacle are in a connected position;

a debris seal on the end face of the cable insulating member comprising an elastomeric insulating disc having a plurality of bores each circumscribing one of the cable contact members; and a plurality of thermal expansion slots in the debris seal, each expansion slot is located at angular positions with respect to a center of the debris seal that are offset from angular positions of the bores and spaced from each of the bores, so that when the debris seal expands in respond to an increase in temperature, material of the debris seal expands into spaces defined by the expansion slots.

10. The assembly of claim 9, wherein the debris seal expands in response to an increase in temperature and wherein substantially all of the expansion is directed into the expansion slot so that a contact force between the debris seal and the end face is substantially constant during the increase in temperature.

11. The apparatus of claim 9, wherein each of the expansion slots has a curved outer periphery.

12. The assembly of claim 9, wherein each of the expansion slots is generally elongate.

13. The assembly of claim 9, wherein the debris seal is a generally planar member set generally perpendicular to the cable contact members.

14. The assembly of claim 9, wherein each of the expansion slots are between the center of the debris seal and an outer periphery of the debris seal and are spaced from the outer periphery of the debris seal.

15. A submersible well pump assembly comprising:

a submersible electrical motor;

an electrical motor lead for connection to a power cable;

a cable end housing for connection to the motor lead;

a cable insulating member of insulating material disposed within the cable end housing and having a plurality of passages therethrough;

a plurality of electrical conducting cable contact members mounted in the passage of the cable insulating member and joined to the motor lead, each of the cable contact members protruding past an end face of the cable insulating member;

a motor insulating member of insulating material mounted in a receptacle of the electrical motor and having a plurality of passages therethrough, the motor insulating member having an end face;

a plurality of electrical conducting motor contact members in each one of the passages of the motor insulating member that is engaged by the cable contact member when the cable end housing and the receptacle are in a connected position;

a generally planar debris seal on the end face of the cable insulating member comprising an elastomeric insulating disc having a plurality of bores each circumscribing one of the cable contact members; and a plurality of thermal expansion slots in the barrier, each thermal expansion slot spaced from each of the bores located on the debris seal at angular positions with respect to a center of the debris seal that are offset from angular positions of the bores, so that when the debris seal expands in response to an increase in temperature, substantially all of the expansion of the debris seal is directed into the plurality of expansion slots so that a contact force between the debris seal and the end faces is substantially constant during the increase in temperature.

16. The apparatus of claim 15, wherein each thermal expansion slot extends from an outer periphery of the debris seal radially inward towards the center of the debris seal.

17. The apparatus of claim 15, wherein each thermal expansion slot is between the center of the debris seal and an outer periphery of the debris seal.

* * * * *

UNITED STATES PATENT AND TRADEMARK OFFICE

CERTIFICATE OF CORRECTION

PATENT NO. : 8,491,282 B2
APPLICATION NO. : 12/838924
DATED : July 23, 2013
INVENTOR(S) : Clark D. Shaver et al.

It is certified that error appears in the above-identified patent and that said Letters Patent is hereby corrected as shown below:

In the Specification:

Column 1, line 52, delete “assembly, in” and insert -- assembly. In --
Column 2, line 45, delete “member, in” and insert -- member. In --
Column 3, line 1, delete “lead, in” and insert -- lead. In --

In the Claims:

Claim 1, Column 6, line 60, after “portions” delete “,”
Claim 4, Column 7, line 24, delete “are” and insert -- is --
Claim 9, Column 7, line 61, after “bores” insert -- , -- before “each”
Claim 14, Column 8, line 19, delete “each of”
Claim 15, Column 8, line 48, delete “barrier” and insert -- disc --

Signed and Sealed this
First Day of April, 2014

Michelle K. Lee

Michelle K. Lee
*Deputy Director of the United States Patent and Trademark Office*